US005088119A

United States Patent [19]

Fortier

[11] Patent Number: 5,088,119

[45] Date of Patent: Feb. 18, 1992

[54] NECKTIE HAVING A KNOT PORTION, DISPLAY PORTION AND TAIL PORTION WITH AN ALIGNED DESIGN WHEN TIED

[76] Inventor: Robert A. Fortier, 1 Hammond Pl., Boynton Beach, Fla. 33462

[21] Appl. No.: 594,604

[22] Filed: Oct. 9, 1990

Related U.S. Application Data

[63] Continuation-in-part of Ser. No. 533,808, Jun. 6, 1990, abandoned.

[51] Int. Cl.[5] ..... A41D 25/06

[52] U.S. Cl. ..... 2/146; 2/144; 2/149; 2/145; 2/148

[58] Field of Search ..... 2/146, 144, 149, 145, 2/148

[56] References Cited

U.S. PATENT DOCUMENTS

| | | | |
|---|---|---|---|
| 1,176,391 | 3/1916 | Meyer | 2/146 |
| 1,273,263 | 7/1918 | Mills, Jr. | 2/146 |
| 1,535,669 | 4/1925 | Kelly | 2/146 |
| 1,721,333 | 7/1929 | Cunningham | 2/146 |
| 1,998,143 | 4/1935 | Newman | 2/146 |
| 2,834,967 | 5/1958 | Taksa | 2/146 |
| 3,950,790 | 4/1976 | Adler | 2/144 |
| 4,696,064 | 9/1987 | Morwood | 2/144 |

FOREIGN PATENT DOCUMENTS

| | | | |
|---|---|---|---|
| 968599 | 11/1950 | France | 2/146 |
| 970262 | 1/1951 | France | 2/144 |
| 1257829 | 2/1961 | France | 2/146 |
| 1365488 | 5/1964 | France | 2/146 |

*Primary Examiner*—Werner H. Schroeder
*Assistant Examiner*—Gloria Hale
*Attorney, Agent, or Firm*—Harry W. Barron

[57] ABSTRACT

A necktie has a central knot portion being positioned between a display portion and a tail portion. In one version, the warp angle of the knot portion is rotated ninety degrees from the warp of the display portion so that the stripes on the knot will be aligned with the corresponding stripes on the display portion when the tie is worn. In other embodiments, the knot portion is a different color or pattern from the display portion to permit coordinating or contrasting or styles between the knot and display portion. In yet another embodiment, the knot portion is made selectively replaceable at the discretion of the user to permit mix and match freedom.

25 Claims, 2 Drawing Sheets

NECKTIE HAVING A KNOT PORTION, DISPLAY PORTION AND TAIL PORTION WITH AN ALIGNED DESIGN WHEN TIED

RELATION TO OTHER PATENTS

This invention is a continuation in part of U.S. patent application Ser. No. 07/533,808, filed June 6, 1990 in the name of Robert A. Fortier and entitled "Necktie", now abandoned.

BACKGROUND OF THE INVENTION

Field Of The Invention

This invention relates to neckties, and more particularly, to neckties in which a different pattern is formed on the necktie at the area thereof with which the knot is formed.

BACKGROUND INFORMATION

Neckties are usually constructed from woven fabrics which, of course, have warp and woof threads making up the structure of the cloth. It has long been known that neckties will withstand the repeated tying and untying to which they are subject better, and retain an attractive drape, if they are cut on a bias, whereby the warp becomes neither vertical nor horizontal when the tie is worn, but assumes an oblique angle in the draped portion of the tie. Many neckties have a decorative figure woven into, or printed on, the fabric in a pattern that repeats consistently in the draped display that hangs in front of the wearer, below the knot. At the knot, however, the decorative pattern is broken since the pattern is rotated 90° in the knot; thus, stripes which are horizontal in the drape tend to be vertical in the knot and vice versa. With the tie structure of the present invention the figure of the drape, particularly if it comprises stripes, will be continued in the knot, and present a strikingly new appearance.

The fabric of some neckties has a solid color, while other neckties utilize a fabric having a 360° symmetrical pattern or a paisley pattern. For these types of neckties, the knot has the same pattern orientation as the draped display. In addition, some ties utilize a variety of different color therein in the patterns thereof. For the single color fabric, the color of clothing with which the tie may be worn may be limited, whereas the tie of multiple colors may be worn with various different colors of clothing. However, even with the multicolored neckties, some colors are more predominant than others and only the most predominant are commonly matched with other clothing.

DESCRIPTION OF THE PRIOR ART

Various persons have suggested neckties in the past where the knot does not have the conventional pattern found with a necktie having the same pattern throughout. For example, French patent 968,599 Published Nov. 30, 1950 in the name of M. Dumas discloses a necktie knot having stripes in the same direction as the striped drape. A similar disclosure is contained in French patent 1,365,488, published May 25, 1964 in the name of M. Charles Martin. In both of these French patents, the tie is divided into two portions, resulting in the tail appearing different than the front. Thus, the conventional 90° pattern rotation found in a knot is replaced by a 180° rotation in the tail.

Others have disclosed neckties made up of various pieces, particularly in the neck area. For example, U.S. Pat. No. Re. 14,142 in the name of W. A. Keys and entitled, "Neckwear" discloses a necktie having a silk strip in the area of the necktie which fits around the collar to permit easier sliding of the necktie to center the knot. Similar structure is shown in U.S. Pat. No. 1,621,336 in the name of S. Rutenberg and entitled, "Necktie And Lining", which shows the lining exposed in the neck area. In both of these patents, the knot is not affected by the different material.

Other ties are made up of different materials for the front and back pieces to effectively permit one tie to appear as one of two different colors in a single unit. For example, see U.S. Pat. No. 2,004,490 in the name of A. T. Lapham and entitled, "Neckwear".

None of the prior art neckties, however permit any desired pattern to be present in the knot without affecting the remainder of the tie. What is needed is a necktie having a knot which may appear as stripes in the same direction as the body, or a knot having a contrasting or coordinating solid color relative to the remainder of the necktie, or even a necktie in which the pattern in the knot may be selectively changed by the user.

SUMMARY OF THE INVENTION

In accordance with one aspect of this invention, there is provided in a necktie of a type having a display portion, a knot portion, and a tail portion, such that when the tie is worn, an exposed knot is formed solely from the knot portion and the display portion is draped forward of the tail portion, the improvement of different patterns being on the display portion and the knot portion.

BRIEF DESCRIPTION OF THE DRAWINGS

Preferred embodiments of the subject invention are hereafter described, with specific reference being made to the following Figures, in which.

DETAILED DESCRIPTION OF PREFERRED EMBODIMENTS

Figure 1:
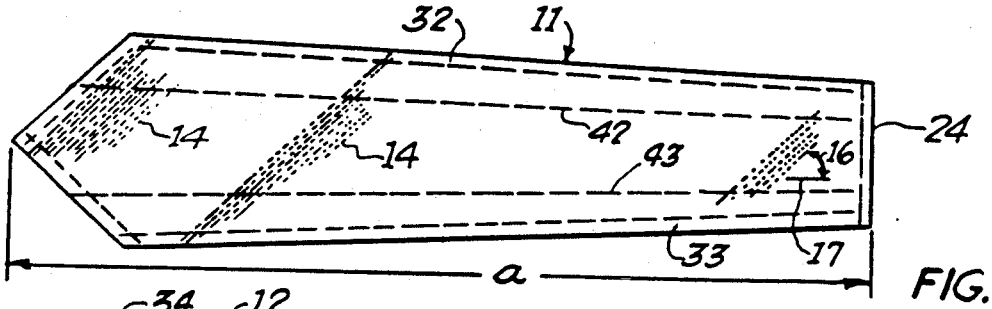
FIG. 1 is a plan view of a pattern-cut display portion of the necktie of the subject invention.
Figure 2:
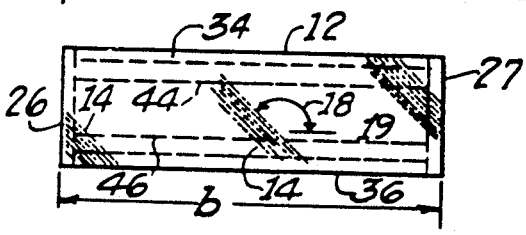
FIG. 2 is a plan view of a pattern-cut knot portion of the necktie of the subject invention.
Figure 3:
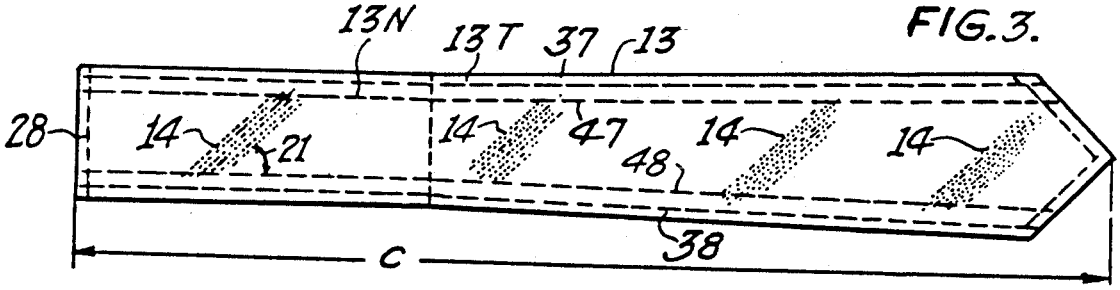
FIG. 3 is a plan view of a pattern-cut tail portion of the necktie of the subject invention.

Referring to FIGS. 1, 2 and 3, a display portion 11 of a necktie of the subject invention has been cut to a set pattern from a supply of fabric, as seen in FIG. 1. In addition, a knot portion 12, as seen in FIG. 2, and a tail portion 13, as seen in FIG. 3 have been cut from the same fabric. The fabric of the display portion 11 has its warp threads 14 sloping upwardly to the right, as seen in FIG. 1; this is true also of the warp threads 14 as they appear in the tail portion 13. However, in the knot portion 12, the pattern has been so cut from the fabric so that the warp 14 appears sloping upwardly toward the left. Thus, the angle 16 of the warp 14 from a line 17 marking the lengthwise direction of the portion 11 differs by ninety degrees (90°) from an angle 18 between the warp 14 of the knot portion 12 and a line 19 marking its lengthwise direction. The equivalent angle 21 of the portion 13 is 90 degrees smaller than the angle 18.

Figure 4:
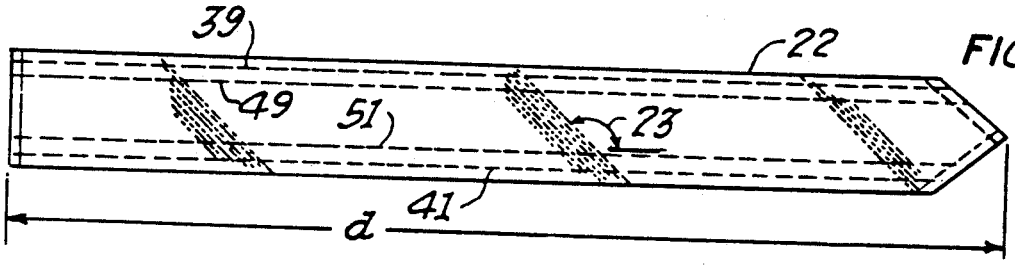
FIG. 4 is a plan view of a pattern-cut combined knot and tail portion of the necktie of the subject invention.

In FIG. 4 the knot and tail portions have been made in a continuous cut 22 so that the angle 23 is the same as the angle 18.

Figure 5:
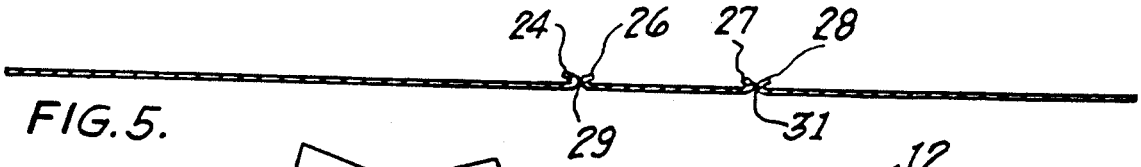
FIG. 5 is an edge view of the display, knot, and tail portions prior to folding.

The ends of the portions 11, 12, 13, and 22 that must be pieced together are marked by border strips 24, 26, 27, 28 which are shown turned up in FIG. 5 and sewn by rows of stitching 29 and 31, although other means of connecting the portions of the necktie of the subject invention, such as adhesive bonding or stapling are included within the scope of the invention. Lengthwise border strips 32, 33; 34, 36; 37, 38; and 39, 41 are provided for sewing the edges of the pattern cuts together along fold lines 42, 43; 44, 46; 47, 48; 49, 51.

In a preferred example of the subject invention the length "a" of the display portion 11 of a finished tie will be about 20 inches (51 cm), the length "b" of the knot portion 12 will be about 9 inches (23 cm), and the length "c" of the tail portion 13 about 29 inches (74 cm), although it will be understood that these dimensions may vary with style within the scope of the subject invention. Generally, the knot portion 12 will be between eight and eleven inches (20 to 28 cm) because this amount of material is needed to form the knot. Changes in tie widths will, of course, affect the length required for the knot portion 12. The other dimensions are not as critical and will vary depending upon the length of the necktie desired. In agreement with the above lengths the length "d" of the portion 22 will be about 38 inches (97 cm). Generally, the length of the knot portion 12 and display portion 11 will approximately equal the length of the tail portion 13. It should be understood that the tail portion 13 includes both a neck portion 13N, which encircles the neck, and a tail 13T, which extends downward behind the display portion 11.

After the border strips 32, 34, 37 have been sewn to the respective strips 33, 36, 39, the assembly of the portions 11, 12, 13 are turned inside out in a known manner to complete a tie. It will be understood that known steps of ironing and adding stiffening strips, facings and linings may be performed within the scope of the subject invention without detracting from the novelty thereof.

Figure 7:
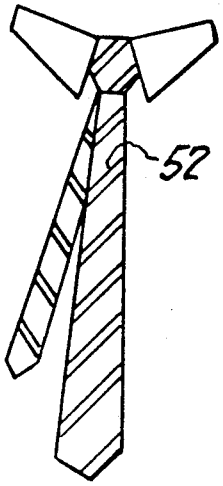
FIG. 7 is a pictorial view of another embodiment of the necktie of the subject invention.
Figure 6:
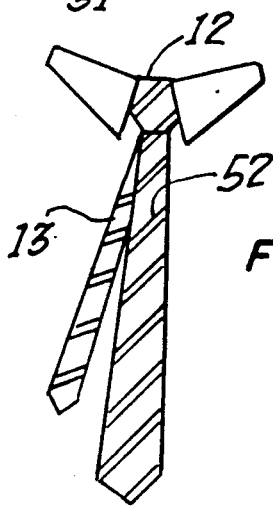
FIG. 6 is a pictorial view of a knotted necktie of the subject invention.

In FIG. 6 the portions 11, 12, 13 have been sewn into a necktie having a FIG. 52 comprising a succession of parallel stripes and it can be seen that the figure on the drape 11 is continued with the same orientation in the formed knot 12 and the tail 13. In FIG. 7 a tie comprised of portions 11 and 22 also continues the orientation of the draped display in the knot but have the orientation of the figure reversed in a tail 53.

Figure 8:
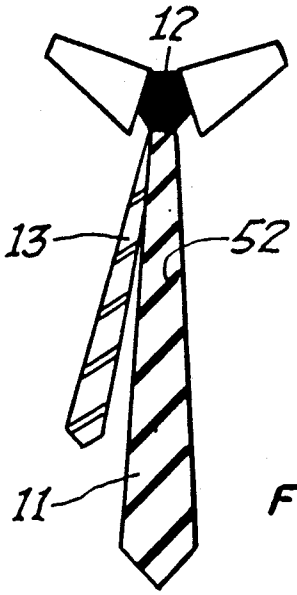
FIG. 8 shows is a pictorial view a different design version of the subject invention.

In FIG. 8, the pattern of knot portion 12 is selected to be a solid color to match or contrast with colors found in the design of the display portion 11 and tail portion 13. The display portion 11 of many neckties include several colors in either stripe or non-stripe patterns and one of these colors may be selected to be matched in a solid colored knot portion 12. Alternatively, the display portion 11 may be a single color and the knot portion 12 may be selected to be a contrasting color.

Figure 9:
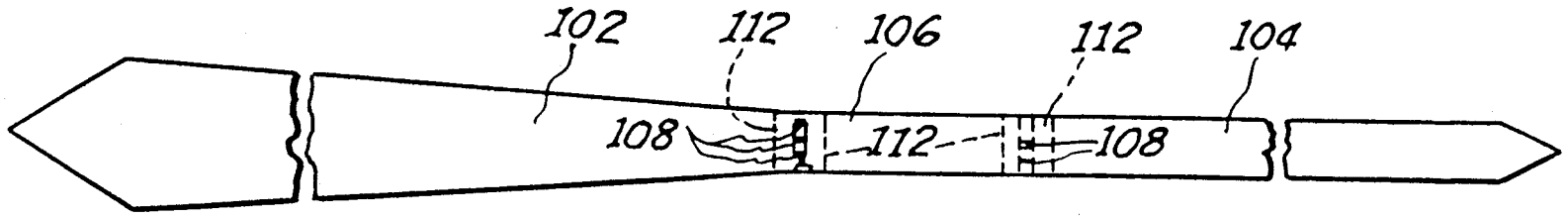
FIG. 9 shows a plan view of another embodiment of the subject invention in which the knot portion is selectively replaceable.
Figure 10:
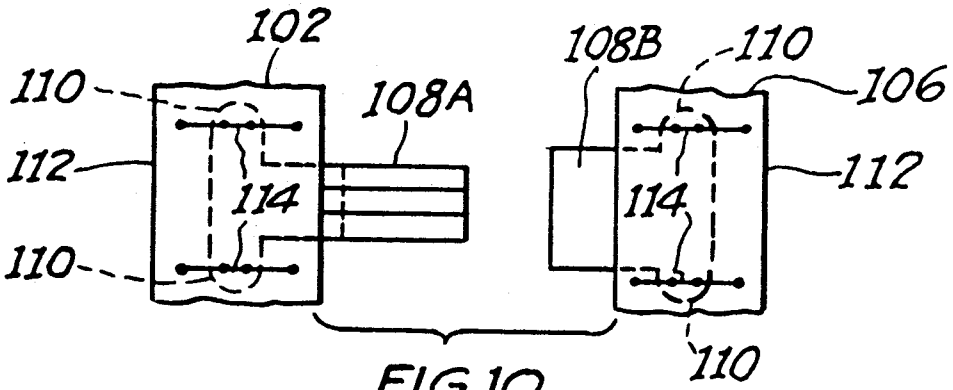
FIG. 10 shows a more detailed view of the clips used to attach the knot portion to the tail or display portions.
Figure 11:
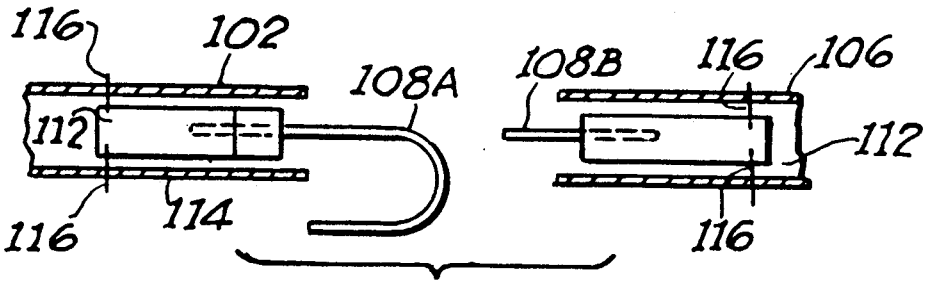
FIG. 11 shows a cross-sectional view across lines 11—11 of FIG. 10.

Referring now to FIGS. 9, 10 and 11, an alternative embodiment of a necktie 100 of the subject invention is shown. For necktie 100, the display portion 102 and tail portion 104 and knot portion 106 are similar to that described above to the extent that different patterns may be present on the knot portion 106 and display portion 102. These different patterns may be stripes at a 90° angle with respect to one another, or may be different colors or patterns. In certain situations, however, the user of necktie 100 may wish to use several different knots portion 106 colors or patterns with the same basic display portion 102 and tail portion 104. The structure illustrated with respect to FIGS. 9, 10 and 11 permits the user to purchase a basic tie pattern for display portion 102 and tail portion 104 together with several different knot portions 106, and then to mix and match the particular color or pattern of knot portion 106 as desired for the remaining clothes being worn.

Clip mechanisms 108 on each end of knot portion 106 are utilized to attach knot portion 106 to respective interior ends of display portion 102 and tail portion 104. More specifically, one of a hook type clip 108A or clip receptacle 108B is attached to the ends of knot portion 106 and the other of a hook type clip 108A or clip receptacle 108B is attached to the interior ends of display portion 102 and tail portion 104. This is best seen in FIGS. 10 and 11. Clip mechanism 108 may be similar to the clip mechanism commonly used to attach the ends of a brassiere together and includes a hook 108A and loop receptacle 108B. The hook portion 108A is in the shape of a sideways U, with one of the U legs being extended in length and having a pair of ears 110 extending outward from the end of that extended leg. The loop receptacle portion 108B of clip 108 is a wire loop sized to receive the non-extended leg of the hook portion 108A.

Both portions 108A and 108B are affixed in a cloth carrier 112 by a row of stitches 114 through the ears 110. Each of the carriers 112, in turn, are secured into the inside of the formed display and tail portions 102 and 104 at the interior end thereof. As seen in FIG. 11, the necktie material of display and tail portions 102 and 104 extends slightly beyond the end of carrier 112 so as to cover carrier 112. In addition, the necktie material of display and tail portions 102 and 104 is attached to carriers 112 by stitches 116.

When the hooks 108A and loops 108B are set in place, the hooks 108A may be inserted through the loops 108B to secure the knot portion between the display portion 102 and tail portion 104. With this structure, the user can select which knot portion 106 design is to be worn for a particular occasion and then affix that selected knot portion 106 in place with the display portion 102 and tail portion 104. For a different occasion, the knot design may be changed by removing the old knot portion 106 and replacing it with another design for the knot portion 106.

It should also be noted that more than one design for the display portion 102 and tail portion 104 may be provided to permit greater mix and match flexibility. In addition, other mechanisms or techniques for attaching the knot portion 106 to the display and tail portions 102 and 104 may be utilized. Such other mechanisms or techniques should, however, present a thin profile to the necktie, so as not to cause any noticeable bulges in the formed knot. It should also be noted that the length of the knot portion 106 is selected to be such that the clips 108 are fully within the formed knot, and thus hidden thereby when the necktie is formed as seen in FIGS. 6, 7 and 8.

What is claimed is:

1. In a necktie having a knot portion, a display portion connected to one end of said knot portion and a tail portion connected to the other end of said knot portion, said knot portion being sized and positioned such that when said tie is worn, an exposed knot is formed solely from said knot portion and said display portion is draped forward of said tail portion, the improvement comprising a different pattern being on said display portion than on said knot portion.

2. The invention according to claim 1 wherein said tail portion has the same pattern as said display portion.

3. The invention according to claim 1 wherein said display, knot and tail portions are integral.

4. The invention according to claim 2 wherein said knot portion has a length of between eight and eleven inches (20 to 28 cm.)

5. The invention according to claim 4 wherein the combined length of said knot and display portions are approximately equal to the length of said tail portion.

6. The invention according to claim 1 wherein said knot portion is replaceably affixed between said display and tail portions.

7. The invention according to claim 6 wherein said tail portion has the same pattern as said display portion.

8. The invention according to claim 6 wherein one of said knot portion or said display and tail portions includes fastening means and the other of said knot portion or said display and tail portions includes fastening receptacles for engaging said fastening means, said fastening means and fastening receptacles affixing said knot portion between said display and tail portions when said fastening means are engaged by said fastening receptacles.

9. The invention according to claim 8 wherein said fastening means are clips and said fastening receptacles are clip receptacles.

10. The invention according to claim 8 wherein said knot portion has a length of between eight and eleven inches (20 to 28 cm.)

11. The invention according to claim 10 wherein the combined length of said knot and display portions are approximately equal to the length of said tail portion.

12. The invention according to claim 11 wherein said fastening means are clips and said fastening receptacles are clip receptacles.

13. The invention according to claim 6 wherein said knot portion has a length of between eight and eleven inches (20 to 28 cm.)

14. The invention according to claim 13 wherein the combined length of said knot and display portions are approximately equal to the length of said tail portion.

15. The invention according to claim 14 wherein said tail portion has the same pattern as said display portion.

16. A necktie displaying a decorative figure and having a display portion, a knot portion, and a tail portion, such that when said tie is worn an exposed knot is formed from said knot portion, said display portion is draped forward of said tail portion and said knot and display portions comprise woven fabric having a warp and a woof cut from a uniform supply of said fabric, wherein:

A) said necktie comprises means attaching said knot portion between said display portion and said tail portion, and B) said warp of said knot portion is turned about 90 degrees from said warp of said display portion whereby the figure of said knot is aligned with the figure of said display portion.

17. The necktie of claim 16 wherein said tail portion comprises said fabric.

18. The necktie of claim 17 wherein the warp of said tail portion is aligned with the warp of said display portion.

19. The necktie of claim 16 wherein said tail portion is an integral continuation of said knot portion.

20. The necktie of claim 16 wherein said attaching means comprises stitching.

21. The necktie of claim 16 wherein said display portion has a length of about 29 inches (74 cm), said knot portion has a length of about 9 inches (23 cm), and said tail portion has a length of about 20 inches (51 cm).

22. The necktie of claim 19 wherein said display portion has a length of about 29 inches (51 cm) and said combined knot and tail portions have a length of about 29 inches (74 cm).

23. The necktie of claim 16 wherein said fabric is cut on a bias.

24. The method of constructing neckties comprising the steps of:

(A) laying out a supply of a woven fabric having a warp and a woof, (B) to a first set pattern cutting from said fabric a plurality of equal elongated display portions all comprising the same angle of warp to long-dimension, (C) to a second set pattern cutting from said fabric a plurality of equal elongated knot portions comprising warp to long-dimension angles about 90 degrees to the warp to long-dimension angles of said display-portions, (D) to a third set pattern cutting from said fabric a plurality of equal elongated tail portions comprising warp to long-dimension angles about equal to the warp to long-dimension angles of said display portions.

(E) sewing a display portion and a tail portion to either end of each knot portion to form three-portion assemblies, (F) folding each said three-portion assembly lengthwise and sewing together the long edges thereof, and (G) turning each of said assemblies inside out.

25. The method of constructing neckties comprising the steps of:

(A) laying out a supply of a woven fabric having a warp and a woof, (B) to a first set pattern cutting from said fabric a plurality of elongated display portions, said portions all comprising the same angle of warp to long-dimension, (C) to a second set pattern cutting from said fabric a plurality of elongated knot-and-tail portions comprising warp to long-dimension angles about 90 degrees from the warp to long-dimension angles of said display portions, (D) sewing a display portion to an end of each knot-and tail portion to form a two-portion assembly, (F) folding said assembly lengthwise and sewing together the long edges thereof: and (G) turning said assembly inside out.

* * * * *